US006124795A

United States Patent [19]

Bernau et al.

[11] Patent Number: 6,124,795

[45] Date of Patent: Sep. 26, 2000

[54] DETECTOR INTERCONNECT SYSTEM

[75] Inventors: Lynn Bernau, Streamwood; Jeffrey M. Klein; Cherie H. Wilkinson, both of Chicago, all of Ill.

[73] Assignee: Pittway Corporation, Chicago, Ill.

[21] Appl. No.: 08/909,193

[22] Filed: Aug. 11, 1997

[51] Int. Cl.[7] ..... G08B 17/10

[52] U.S. Cl. ..... 340/628; 340/532; 340/533

[58] Field of Search ..... 340/628, 632, 340/539, 532, 533

[56] References Cited

U.S. PATENT DOCUMENTS

| | | | |
|---|---|---|---|
| 3,926,101 | 12/1975 | Moss | 454/229 |
| 4,207,558 | 6/1980 | Kunzer | 340/524 |
| 4,282,519 | 8/1981 | Haglund et al. | 340/628 |
| 4,286,159 | 8/1981 | Kitta et al. | 250/381 |
| 4,287,515 | 9/1981 | Raber et al. | 340/584 |
| 4,394,655 | 7/1983 | Wynne et al. | 340/825 |
| 4,818,970 | 4/1989 | Natale et al. | 340/539 |
| 4,916,432 | 4/1990 | Tice et al. | 340/518 |

*Primary Examiner*—Edward Lefkowitz
*Attorney, Agent, or Firm*—Rockey, Milnamow & Katz Ltd.

[57] ABSTRACT

A duct mountable smoke detector includes a smoke sensor, an alarm indicating output relay, and an air flow control relay. In the presence of an alarm condition, the alarm indicating relay is energized thereby producing an alarm indicating signal. The air flow control relay is also energized thereupon changing an operative state of the respective air flow control element. Finally, a signal is coupled to an input/output interconnect port and, via an interconnect link, to other detectors coupled to the link. Other detectors coupled to the link which receive an alarm indicating interconnect signal energize the respective air flow control relays thereby changing operative state of the respective air flow control devices. The other detectors do not enter an alarm state. This allows for easy determination of the detector that initiated the alarm.

20 Claims, 4 Drawing Sheets

DETECTOR INTERCONNECT SYSTEM

FIELD OF THE INVENTION

The invention pertains to circuits for interconnecting spaced apart ambient condition detectors. More particularly, the invention pertains to circuitry for interconnecting fire or smoke detectors.

BACKGROUND OF THE INVENTION

Smoke detectors are usable to monitor a region of interest. While they are usable individually, there has long been an interest in interconnecting a plurality of detectors using a common communication link. One such system has been disclosed and claimed in Tice et al. U.S. Pat. No. 4,916,432 entitled Smoke and fire Detection System Communication. The Tice et al. patent is assigned to the assignee hereof and incorporated herein by reference.

While systems of the type disclosed in the Tice patent are useful there are alternate circuit configurations for interconnecting detectors. One such alternate configuration has been disclosed in U.S. Pat. No. 4,207,558 entitled Interconnecting Circuit For A Plurality Of Alarm Units.

So-called four wire detectors can be configured to operate off of a common two wire power loops. Such loops can be used to supply energy to the detectors coupled thereto. Alternately, the loop can be used to transfer information as in the Tice et al. patent.

Other connections to such detectors can be used via a second loop, to provide status signals. Such detectors, if coupled to an HVAC-type duct, can be used to terminate the operation of one or more fans, or to close one or more dampers in the presence of an alarm condition.

In known installations, a single such detector will usually control a single fan, blower, damper or other control device. In known installations, where multiple fans, blowers or dampers were to be controlled, external control panels or relays have been used.

It would be desirable to be able to control multiple fans, blowers or the like without having to incorporate additional relays or control panels. It would also be desirable to be able to change the operational state of a plurality of such elements without necessarily causing all detectors to emit an alarm indicator.

SUMMARY OF THE INVENTION

An alarm system can be used with a plurality of air control elements such as fans, blowers or dampers. The system will shut down or close the respective fans, blowers or dampers in response to a single member of a plurality of interconnected detectors going into an alarm state.

The detectors can, in one aspect, each include an ambient condition sensor and circuitry for establishing the presence of an alarm condition. The detectors can also each generate an alarm indicating output signal, an air handling element control signal and an interconnect signal at an interconnect input/output port. The interconnect input/output port is bidirectional.

Where an alarm condition has been detected, a respective alarm signal is generated as an output at the respective detector. That signal can be used, if desired, to produce a plurality of visual and audible alarm indications. Additionally, the state of the associated air handling device can be changed.

The alarm indicating signal can also be coupled to an interconnect input/output port for purposes of communicating to remaining members of the plurality an alarm indicating interconnect signal. This signal can in turn be used to change the state of the air handling element of each of the respective members of the plurality. The remaining members of the plurality which receive the interconnect signal do not necessarily enter an alarm state.

In one aspect, the detectors are each contained in a housing. The housing carries an ambient condition sensor such as a smoke or fire sensor.

In another embodiment, the housings can carry one or more sampling tubes. In this embodiment, the detector can be coupled to an internal air or fluid containing region of an HVAC duct.

An alarm indicating output can be coupled to alarm indicating audio/visual output devices. An air handling control element, a relay, can be coupled to the alarm determination circuitry as well as an associated air handling element such as a fan, a blower, a damper or other control element.

In the presence of an alarm condition, the associated fan or blower can be de-energized. The associated damper can be opened or closed. Simultaneously, the interconnect alarm indicating signal is generated and transmitted to all other detectors coupled to the interconnect link.

In another aspect, the alarm indicating output signal can be coupled to a latching solid state element, for example a silicon controlled rectifier. This switch can be used to establish an alarm indicating relay coil drive current. The presence of the drive current in turn can be used to close alarm indicating contacts and generate a signal usable to produce an audible or visible alarm output.

The coil drive circuitry can in turn be coupled to additional relay drive circuitry for the purpose of energizing an air handling relay coil so as to change the operative state of a respective air handling element. Finally, the alarm indicating relay drive circuitry can be used to couple an interconnect signal, indicating the presence of an alarm condition at one detector, to other detectors coupled to the interconnect link.

Signals received at respective detectors on their interconnect input/output ports in turn energize the respective air handling equipment drive circuitry. This in turn energizes the respective air handling control element control relay causing it to change state thereupon changing the operative state of the associated air handling element. The received interconnect signal need not be coupled to the respective alarm output indicating circuitry.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
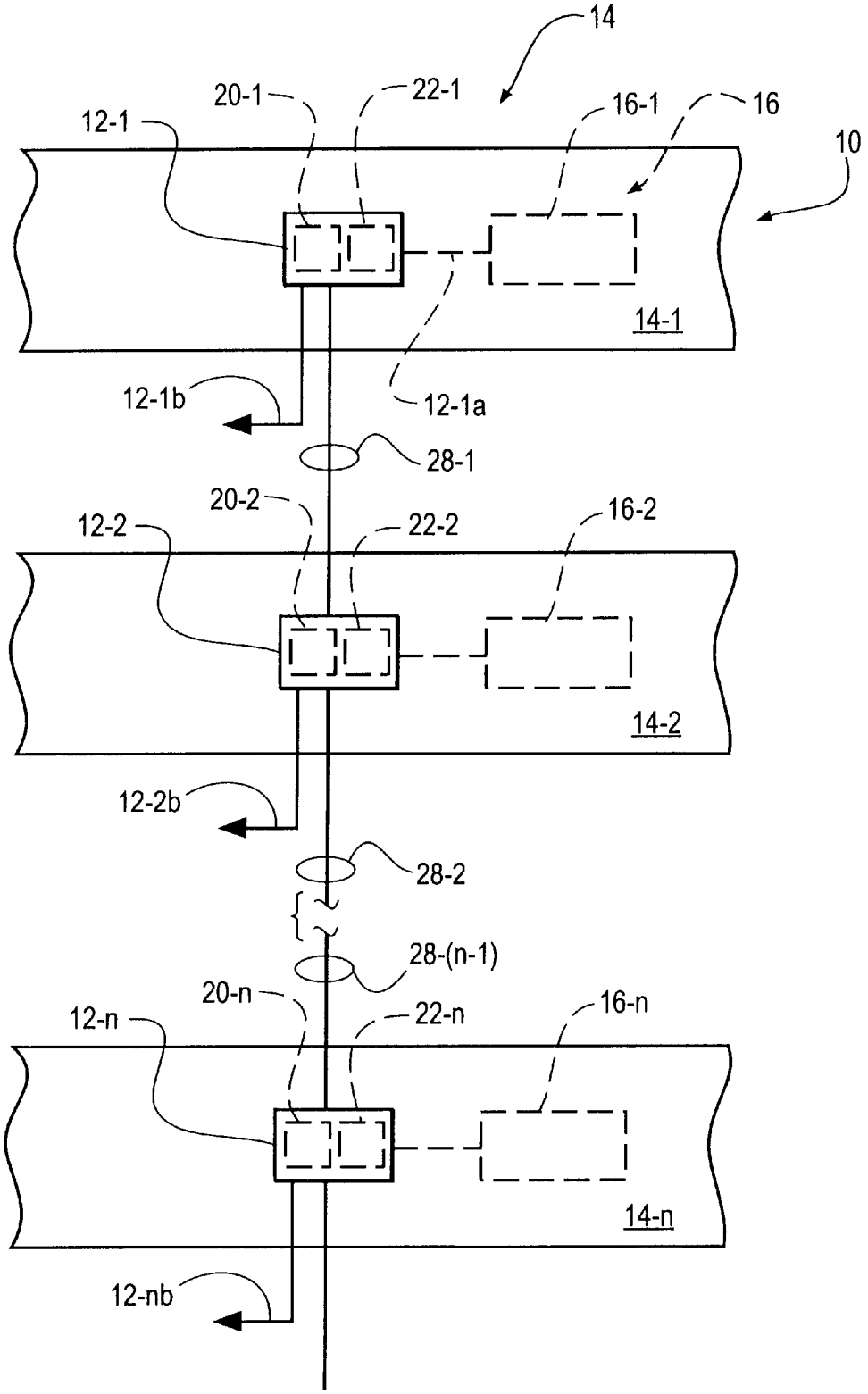
FIG. 1 is a over-all partial diagram of the system usable with a plurality of duct detectors.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a system 10 which includes a plurality of ambient condition detectors 12. In the embodiment illustrated in FIG. 1, the detectors 12 are connectable to respective HVAC ducts 14.

The members of the plurality 12, such as 12-1, 12-2 . . . **12-*n* each are couplable to a respective fluid or air moving element such as fan, blower or damper control device 16-1, 16-2, . . . 16-*n*. So long as none of the members of plurality 12 have entered an alarm state, the members of the plurality 16** can be energized in accordance with over-all building control of the HVAC system.

Each of the members of the plurality 12 includes an ambient condition sensor, illustrated in phantom, such as the sensor 20-1, 20-2 . . . **20-*n*. Additionally, each of the members of the plurality 12 includes control electronics 22-1, 22-2 . . . 22-*n***.

The members of the plurality 12 also include an alarm indicating output port or a line **12-1*b*, 12-2*b* . . . 12-n*b***. Each of the output lines carries an electrical signal which is indicative of the respective detector having entered an alarm state. Each of the lines can be coupled to one or more alarm indicating devices such as horns or strobe lights thereby providing a self-contained alarm system without the necessity of having an external control element.

The members of the plurality 12 are interconnected by multiple conductor links 28-1, 28-2 . . . 28-(n−1). The links 28 can include for example a two wire power loop with each of the members of the plurality 12 coupled in parallel therewith and receiving electrical energy therefrom. The links 28 can also include an interconnect communication line coupled to each of the members of the plurality 12.

The interconnect communication line enables a member of the plurality 12, which has entered an alarm state, to communicate that state to all of the other members of the plurality 12. The member of the plurality 12 which has entered the alarm state will in response thereto produce an alarm indicating signal on the respective line **12-1*b*, 12-2*b* . . . 12-n*b*. The state of the respective member of the plurality 16** can be changed.

In addition, via the interconnect line, all of the remaining members of the plurality 12 can alter the operational state of their respective air control element. The system 10 is cost-effective and advantageous in that the state of all of the members of the plurality 16 can be altered using only the control relays already present in each of the members of the plurality 12 and without any need for additional control panels or relays.

Figure 2:
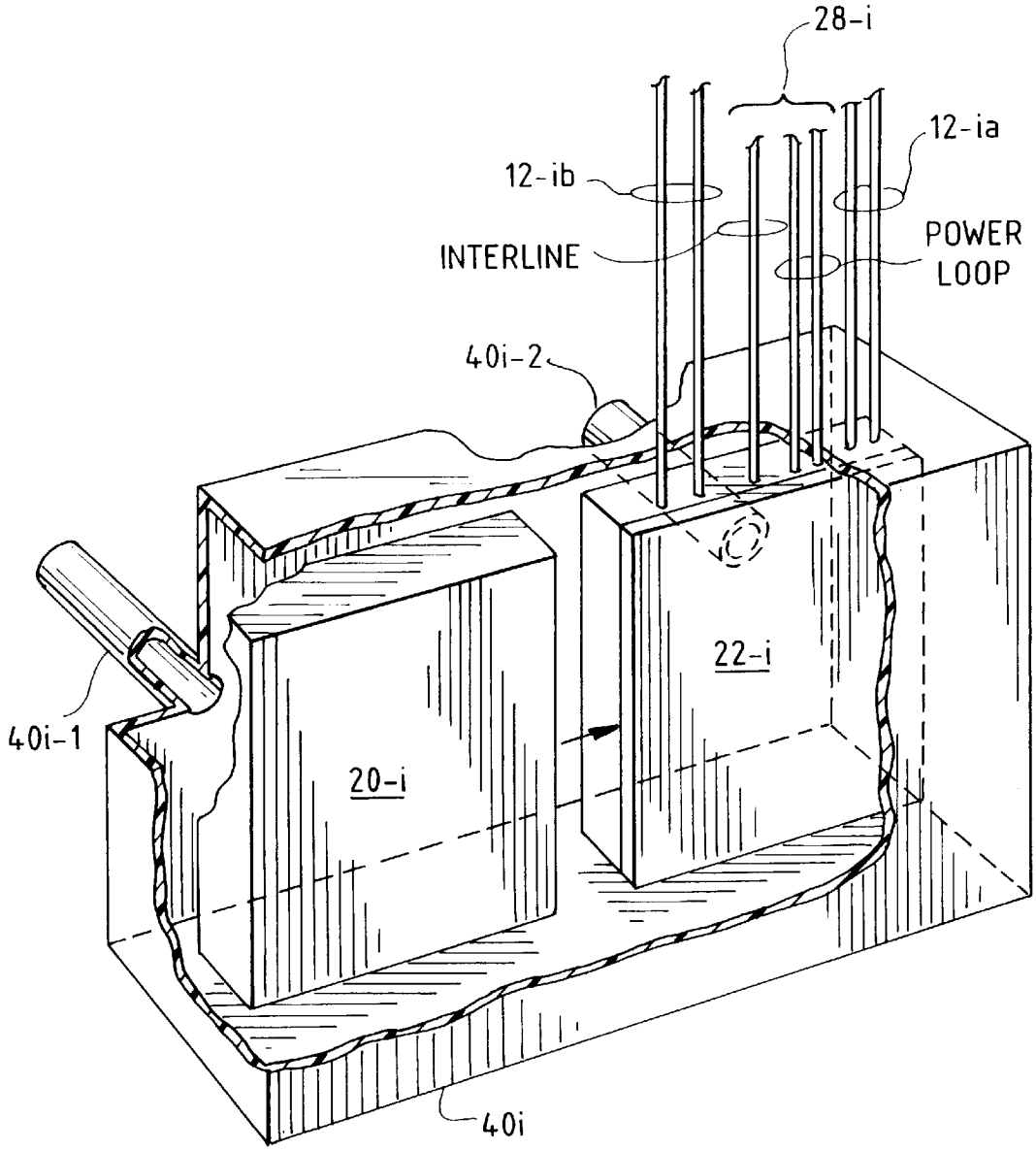
FIG. 2 is an over-all perspective diagram of one of the detectors of FIG. 1.

FIG. 2 illustrates further details of a representative member **12-*i* of the plurality 12. The detector 12-*i* includes a housing 40-*i* which carries the respective transducer 20-*i* and associated control circuitry 22-*i***.

The housing **40-*i* as illustrated in the embodiment of FIG. 1, carries at least first and second sampling tubes, 40*i*-1, −2 as would be known to those of skill in the art. The sampling tubes 40*i*-1, −2 are intended to extend into the respective duct, such as the duct 14-*i* to provide a fluid flow stream for the transducer 20-*i***.

The transducer **20-*i*** could be implemented, for example as a smoke or gas sensor. Other types of sensors could be used without departing from the spirit and scope of the invention.

Figure 3:
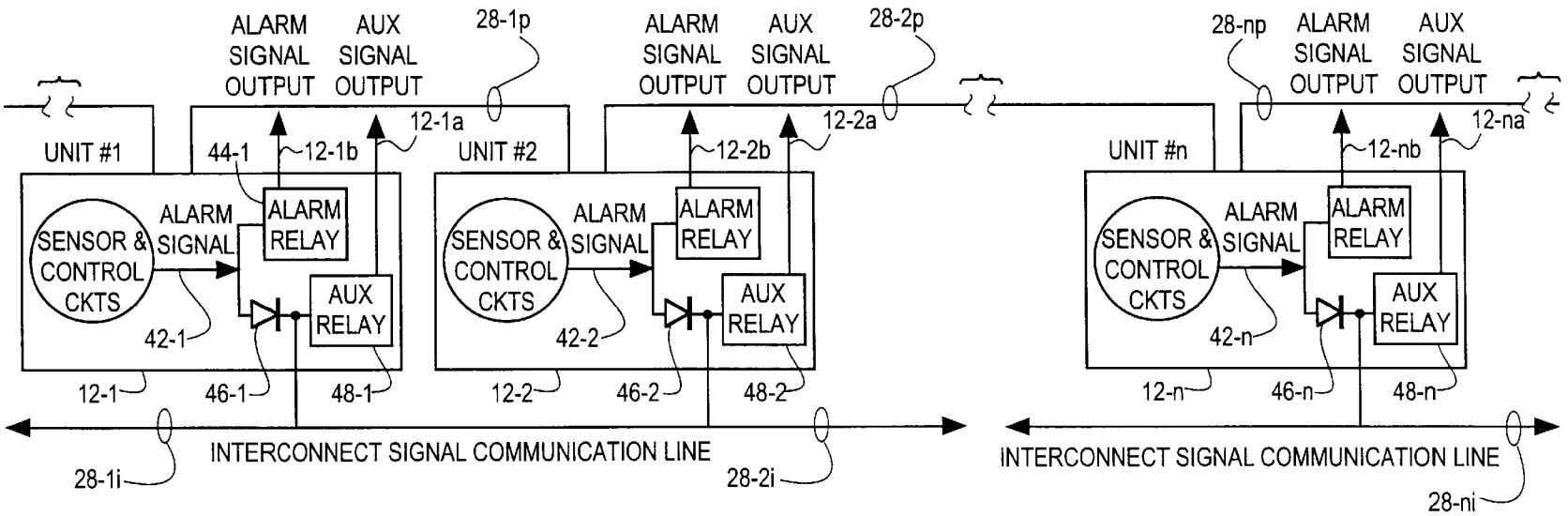
FIG. 3 is a block diagram illustrating additional details of the system detectors of FIG. 1.

FIG. 3 is a block diagram illustrating the members of the plurality 12 in more detail. The members of the plurality 12, as noted above, are each coupled in parallel to a power supplying loop indicated by segments **28-1*p*, 28-2*p* . . . 28-*np*. In addition, the members of the plurality are coupled by the interconnect signal communication line indicated by 28-1*i*, 28-2*i* . . . 28-*ni***.

Each of the members of the plurality, such as exemplary member 12-1, includes sensor and control circuitry which can be used to detect the presence of an ambient condition, such as a predetermined level of smoke. The respective sensor and control circuitry, in response to having detected the predetermined level of the selective ambient condition, generate an alarm indicating signal on a line 42-1.

The alarm indicating signal is in turn coupled to an alarm indicating relay 44-1 which when energized changes state and produces an alarm signal output on the line **12-1*b*. The alarm signal output on the line 12-1*b*** can in turn be used to produce a human perceptible indication of an alarm state such as by activating a horn or a strobe light.

The line 42-1 is also coupled by a blocking diode 46-1 to an input port of an auxiliary relay 48-1. The contacts of auxiliary relay 48-1 are coupled to the auxiliary signal output line **12-1*a*** and subsequently to the respective air control element which could be a fan, blower or damper.

Hence, when the detector 12-1 goes into alarm, the alarm signal on the line 42-1 energizes the alarm relay 44-1 which in turn produces an alarm output signal on the line **12-1*b*. Additionally, via blocking diode 46-1, the auxiliary relay 48-1 is energized enabling the detector 12-1** to open or close its respective damper or to de-energize its respective blower or fan or alter the state of any other control element.

The alarm signal is also coupled to the interconnect signal line **28-1*i* and to all of the other detectors such as detector 12-2 . . . 12-*n*. This signal in turn energizes the respective auxiliary relays such as 48-2 . . . 48-*n***. Hence, the associated plurality of control devices such as dampers, fans or blowers or other devices can be opened, closed or de-energized as appropriate without any need for additional relays or control panels.

Due to the presence of the respective blocking diodes such as the diodes 46-2 . . . **46-*n*, the respective detectors such 12-2 . . . 12-*n* do not go into alarm in response to the signal on the interconnect line. Alternately, the detectors could be configured such that the detector which has gone to alarm, such as the detector 12-1, via its associated alarm relay 44-1 emits a signature of alarm indicating signal. In this embodiment, the remaining detectors 12-2 . . . 12-*n* could be configured to respond to the signal on the interconnect line and to emit a different signal indicating that another detector namely 12-1 has gone into alarm, along with energizing the respective auxiliary relay such as 48-2 . . . 48-*n***.

Figure 4:
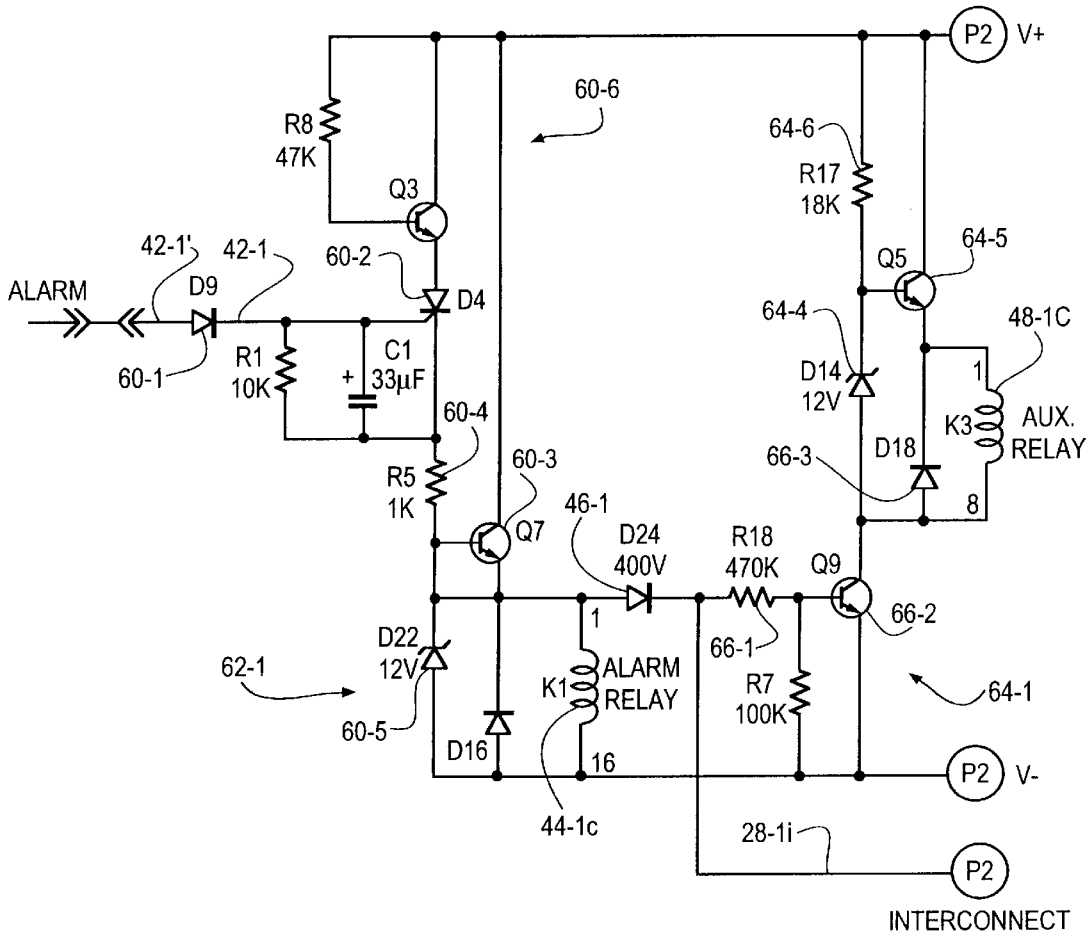
FIG. 4 is a schematic diagram of a portion of the circuitry of the detector of FIG. 2.

FIG. 4 is a schematic diagram of circuitry usable to drive the respective alarm relays such as 44-1 . . . **44-*n* and auxiliary relays 48-1 . . . 48-*n*. The circuitry of FIG. 4 will be discussed relative to detector 12-1. Similar circuitry could be incorporated into the remaining detectors 12-2 . . . 12-*n***. Further discussion of those detectors is not necessary.

As illustrated in FIG. 4, an alarm indicating signal from the respective sensor and control circuitry on a line 42-1' is coupled via blocking diode 60-1 to the line 42-1. The line 42-1 is in turn coupled to drive circuitry 62-1 for relay coil **44-1*c*. Energizing relay coil 44-1-*c* opens or closes the respective contacts of the alarm relay 44-1**.

The alarm indicating signal on the line 42-1 is coupled to a trigger input of a silicon controlled rectifier 60-2 which in the circuit of FIG. 4 functions as a solid state latching switch. The cathode of the switch 60-2 is in turn coupled to a base input of transistor 60-3 via limiting resistor 60-4.

A Zener diode 60-5, coupled to the resistor 60-4 establishes an operating voltage for the base emitter junction of the transistor 60-3, an emitter follower, which in turn provides drive current to the relay coil 44-1*c*. Current for the switch 60-2 is provided by source 60-6.

In view of the latching characteristics of the silicon controlled rectifier 60-2, once the alarm signal on the line 42-1 has triggered that switch and latched it in the on state, it is necessary to reset the detector 12-1 to turn off the alarm indicator.

An anode of the diode 46-1 is coupled to an emitter of the transistor 60-3 and provides base drive current for relay coil driver 64-1. In addition, the cathode of the diode 46-1 is in turn coupled to the interconnect line 28-1*i*.

Drive current from the cathode of the diode 46-1 provided by resistor 66-1 is in turn coupled to a base input of switching transistor 66-2.

A collector of the transistor 66-2 is coupled to relay coil 48-1*c* of the auxiliary relay 48-1. The collector of the transistor 66-2 is also coupled to an anode of a voltage suppression diode 66-3 and Zener diode 66-4.

When the transistor 66-2 conducts the Zener diode 64-4 establishes a base-emitter junction plus relay coil voltage drop. In this mode, relay coil drive transistor 64-5 functions as an emitter follower and receives base drive via resistor 64-6.

It will be understood that the schematic of FIG. 4 could be modified by those of skill in the art without departing from the spirit and scope of the present invention.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An alarm apparatus for use with a controllable air handling system comprising:

a plurality of ambient condition detectors wherein each detector includes at least an alarm output port, an interconnect input/output port, an air handling system output port and control circuitry coupled to the handling system output port;

a hardwired interconnect link coupled to a respective input/output port of at least some of the members of the plurality wherein in response to at least one of the interconnected detectors entering an alarm state, the remaining interconnected detectors each produce a respective air handling system control signal; and wherein at least some of the detectors including circuitry having an alarm condition indicating output state wherein that state, when present at a detector, is coupled to the interconnect input/output ports of the members of the plurality but is coupled to the alarm output port of only the respective detector.

2. An apparatus as in claim 1 wherein at least some of the interconnected members each include an alarm indicating device.

3. An apparatus as in claim 2 wherein the alarm indicating device includes an ambient condition sensor.

4. An apparatus as in claim 3 wherein the ambient condition sensor comprises a smoke sensor.

5. An alarm apparatus for use with a controllable air handling system comprising:

a plurality of ambient condition detectors wherein each detector includes at least an alarm output port, an interconnect input/output port, an air handling system output port and control circuitry coupled to the handling system output port;

a hardwired interconnect link coupled to a respective input/output port of at least some of the members of the plurality wherein in response to at least one of the interconnected detectors entering an alarm state, the remaining interconnected detectors each produce a respective air handling system control signal;

wherein at least some of the detectors including circuitry having an alarm condition indicating output state wherein that state, when present at a detector, is coupled to the interconnect input/output ports of the members of the plurality but is coupled to the alarm output port of only the respective detector: and wherein the control circuitry includes a bidirectional branch coupled to the input/output port, a unidirectional branch coupled to the detector and a unidirectional branch coupled to the air handling system output port wherein the branches share a common node.

6. A duct detector comprising:

a housing attachable to a duct of an air handling system;

interconnect link circuitry carried by the housing;

alarm indicating circuitry, coupled to the interconnect link circuitry;

air system control output circuitry coupled to the interconnect link circuitry;

at least one intake tube carried by the housing wherein the tube extends into the duct when the housing is attached thereto; and which includes a smoke sensor at least coupled to the tube whereby the sensor is exposed to at least some of the air in the duct.

7. A detector as in claim 6 which includes alarm determination circuitry coupled between the smoke sensor and the alarm indicating circuitry.

8. A detector as in claim 6 wherein the alarm determination circuitry is unidirectionally coupled to the interconnect link circuitry thereof.

9. A detector as in claim 8 wherein a signal received on the interconnect link is coupled to the air system control output circuitry but not the alarm indicating circuitry.

10. A detector as in claim 6 wherein the interconnect link circuitry is couplable to an interhousing interconnect conductor.

11. A system of linked duct detectors wherein the detectors are mountable onto air flow ducts in a building being monitored, the system comprising:

a plurality of duct detectors wherein each detector includes a housing attachable to a respective duct, at least one sensor for monitoring air flowing therein for the presence of a selected ambient condition, control output circuitry for altering a respective duct flow parameter in response to the respective sensor detecting the selected ambient condition wherein the control output circuitry is couplable to a respective duct control element, wherein each detector includes a signaling port for sending signals to other members of the plurality in response to detecting the ambient condition and receiving signals from other members of the plurality and wherein each detector includes circuitry for responding to a received signal from another detector to alter only the respective duct control element.

12. A system as in claim 11 which includes a communication link coupled between detector signaling ports.

13. A system as in claim 12 wherein the link comprises a cable.

14. A system as in claim 13 wherein the cable comprises at least one electrical conductor.

15. A system as in claim 12 wherein at least some of the sensors are selected from a class which includes a fire sensor and a gas sensor.

16. A system as in claim 12 wherein the circuitry for responding does not create a detector alarm output signal.

17. An alarm apparatus for use with an air handling system having a plurality of ducts, the apparatus comprising:

a plurality of ambient condition detectors wherein each detector is couplable to a respective duct and each includes at least one duct sensor, an interconnect input/output port, an air handling duct output port and control circuitry coupled to the duct output port; and an interconnect link coupled between respective input/output ports of at least some of the members of the plurality wherein in response to at least one of the interconnected detectors entering an alarm state, the remaining interconnected detectors each produce a respective duct control signal.

18. An apparatus as in claim 17 wherein the sensors comprise at least one of a smoke sensor and a gas sensor.

19. An apparatus as in claim 17 wherein at least some of the detectors include circuitry having an alarm condition indicating output state wherein that state, when present at a detector, is coupled to the interconnect input/output ports of other members of the plurality but does not generate an alarm at the other members of the plurality.

20. An apparatus as in claim 17 wherein the control circuitry includes a bidirectional branch coupled to the input/output port, and a unidirectional branch coupled to the sensor.

* * * * *